US006152110A

United States Patent [19]

Miyajima et al.

[11] Patent Number: 6,152,110

[45] Date of Patent: Nov. 28, 2000

[54] FUEL SUPPLY APPARATUS

[75] Inventors: Masayasu Miyajima; Hirokazu Inoue, both of Tokyo, Japan

[73] Assignee: Mitsubishi Denki Kabushiki Kaisha, Tokyo, Japan

[21] Appl. No.: 09/249,092

[22] Filed: Feb. 12, 1999

[30] Foreign Application Priority Data

Sep. 1, 1998 [JP] Japan ..... 10-246653
Oct. 6, 1998 [JP] Japan ..... 10-283970

[51] Int. Cl.[7] ..... F02M 33/04

[52] U.S. Cl. ..... 123/457; 123/458

[58] Field of Search ..... 123/457, 458, 123/574, 510–11

[56] References Cited

U.S. PATENT DOCUMENTS

| | | | |
|---|---|---|---|
| 4,539,959 | 9/1985 | Williams | 123/457 |
| 4,902,359 | 2/1990 | Takeuchi et al. | 148/133 |
| 5,035,223 | 7/1991 | Watanabe | 123/457 |
| 5,749,345 | 5/1998 | Treml | 123/457 |

FOREIGN PATENT DOCUMENTS

| | | | |
|---|---|---|---|
| 7-83134 | 3/1995 | Japan | F02M 37/00 |
| 8-158974 | 6/1996 | Japan | F02M 37/08 |
| 8-270520 | 10/1996 | Japan | F02M 39/02 |

*Primary Examiner*—Thomas N. Moulis
*Attorney, Agent, or Firm*—Sughrue, Mion, Zinn, Macpeak & Seas, PLLC

[57] ABSTRACT

A fuel supply apparatus includes: a high-pressure pump driven by an engine and ejecting high-pressure fuel; a delivery pipe storing the high-pressure fuel ejected from the high-pressure pump in a pressurized state; and a high-pressure regulator having a valve and a valve seat, and adjusting the fuel pressure in one of the high-pressure pump and the delivery pipe. At least one of abutment surfaces of the valve and the valve seat is set to have a hardness of Hv800 or more.

6 Claims, 11 Drawing Sheets

FUEL SUPPLY APPARATUS

BACKGROUND OF THE INVENTION

1. Field of the Invention

The present invention relates to the improvement of a fuel supply apparatus to an internal combustion engine having a high-pressure pump and a high pressure regulator.

2. Description of the Related Art

An example of such a kind of conventional fuel supply apparatus to an internal combustion engine, in particular, a fuel supply apparatus which has been applied to an in-cylinder direct fuel injection type gasoline engine will be explained with reference to FIGS. 13 to 15. First, in FIG. 13, a reference numeral 1 designates a fuel tank in which gasoline is stored, 2; a low-pressure pump provided within the fuel tank 1, 3; a low-pressure regulator coupled to the low-pressure pump for adjusting the pressure of the fuel ejected from the low-pressure tank 2, 4; a high-pressure pump driven by the engine for ejecting the fuel supplied from the low-pressure pump 2 with a high pressure. The high-pressure pump 4 is secured to cylinder head or the like of the engine. A reference numeral 5 designates a delivery pipe coupled to an electromagnetic type injectors (not shown) for storing the high-pressure fuel supplied from the high-pressure pump 4 in a pressurized state. A reference numeral 6 designates a high-pressure regulator, for adjusting the fuel pressure within the delivery pipe 5 at a predetermined value, having one end coupled to the delivery pipe 5 and the other end returned to the fuel tank 1.

The detailed structure of the high-pressure regulator 6 will be explained with reference to FIGS. 14 and 15. In these figures, a reference numeral 60 designates a housing, 61; a passage formed in the housing and communicating with the delivery pipe 5, 62; a passage formed in the housing 60 and returned to the fuel tank 1 side, 63; a valve seat having a seat portion 63*a* serving as an abutment portion. A reference numeral 64 designates a valve, 64*a*; a seat portion capable of abutting against the seat portion 63*a*. A reference numeral 65 designates a spring pressing the valve to the valve seat 63 side, 66; a spring guide for guiding the spring threrealong, 67; an adjusting screw for adjusting the position of the spring guide 66, and 68; a spacer in which the adjusting screw is mounted so as to be screwed therein. The spacer 68 is secured to the housing 60. A reference numeral 69 designates a cylindrical sleeve attached between the valve seat 63 and the spacer 68 within the housing 60. The surfaces of the respective seat portions 63*a* and 64*a* are formed to have the Vickers hardness (Hv) of about Hv650.

According to such a fuel supply apparatus, the fuel pressurized to a some extent by the low-pressure pump 2 is further pressurized by the high-pressure pump 4 to a predetermined pressure value. In this case, the pressure of the fuel ejected from the low-pressure pump 2 is stabilized within a predetermined range by the low-pressure regulator 3, and further the pressure of the fuel ejected from the high-pressure pump 4 is stabilized within a predetermined range by the high-pressure regulator 6.

The fuel pressurized by the low-pressure pump 2 is further pressurized by the high-pressure pump 4, then supplied to the delivery pipe 5 and injected into the cylinders of the engine through injectors at predetermined timings.

The high-pressure regulator 6 operates in the following manner. That is, the valve 64 separates from the valve seat 63 against the biasing force of the spring 65 when the fuel pressure within the delivery pipe 5 exceeds a predetermined value. Thus, the fuel supplied from the delivery pipe 5 is returned to the fuel tank 1 through the clearance between the valve 64 and the valve seat 63 and the passage 62, and hence the fuel pressure within the delivery pipe 5 decreases. When the fuel pressure within the delivery pipe 5 decreases to the predetermined value, the valve 64 is pressed to the valve seat 63 side by the biasing force of the spring 65. Then, the valve 64 abuts against the valve seat 63 thereby to cut off the flow of the fuel to the return side. Thereafter, when the fuel pressure within the delivery pipe 5 increases and exceeds the predetermined value, the aforesaid operation is repeated again thereby to adjust the fuel pressure at the predetermined value.

According to the conventional high-pressure regulator 6, since the valve 64 abuts against the valve seat 63, the seat portions 63*a* and 64*a* serving as the abutment portions thereof are worn away.

In particular, in the case where the temperature of the fuel becomes high and the pressure of the fuel decreases at the time of passing through the seat portion 64*a* of the valve 64, the fuel boils and becomes gaseous. As a consequence, the valve 64 abuts against the seat portion 63*a* of the valve seat 63 in a substantially dehydrated state, so that the abutment portions thereof are worn away more easily.

Further, bubbles are generated in the fuel due to the fuel pressure reduction when the fuel passes through the seat portions 64*a*, 63*a* of the valve 64 and the valve seat 63, whereby the cavitation erosion is caused and so the surfaces of the seat portions 64*a*, 63*a* of the valve 64 and the valve seat 63 become uneven.

When the abrasion or the cavitation erosion are caused at the valve 64 and the valve seat 63 of the high-pressure regulator 6 in this manner, the sealing property between the valve 64 and the valve seat 63 is degraded, so that the high-pressure regulator 6 can not perform the pressure control operation normally. As a consequence, there arises a problem that the fuel pressure within the delivery pipe 5 decreases and hence the fuel can not be injected suitably from the injectors.

In particular, in the case of the abrasion, although the sealing property can be maintained so long as the abrasion portions of the valve 64 and the valve seat 63 do not slide to each other, the sealing property degrades when the abrasion portions thereof slides to each other.

SUMMARY OF THE INVENTION

An object of the present invention is to obviate the aforesaid conventional problem and to provide an excellent fuel supply apparatus described below.

In order to achieve the aforesaid object, there is provided a fuel supply apparatus includes: a high-pressure pump driven by an engine and ejecting high-pressure fuel; a delivery pipe storing the high-pressure fuel ejected from the high-pressure pump in a pressurized state; and a high-pressure regulator having a valve and a valve seat, and adjusting the fuel pressure in one of the high-pressure pump and the delivery pipe. At least one of abutment surfaces of the valve and the valve seat is set to have a hardness of Hv800 or more.

In addition, in the above fuel supply apparatus, the high-pressure regulator maybe disposed between the high-pressure pump and the delivery pipe.

Further, both the high-pressure regulator and the high-pressure pump may be mounted in the same casing.

Moreover, insulating material may be provided at the attachment surface of the high-pressure regulator.

In addition, the back pressure of 1 kgf/cm$^2$ or more may be applied to the return side of the high-pressure regulator.

Further, the return side of the high-pressure regulator may be returned to the suction side of the high-pressure pump.

BRIEF DESCRIPTION OF THE DRAWINGS

Similar reference characters denote corresponding features consistently throughout the attached figures. The preferred embodiments of this inveniton will be described in detail, with reference to the following figures, wherein.

DETAILED DESCRIPTION OF THE PREFERRED EMBODIMENTS

First Embodiment

Figure 1:
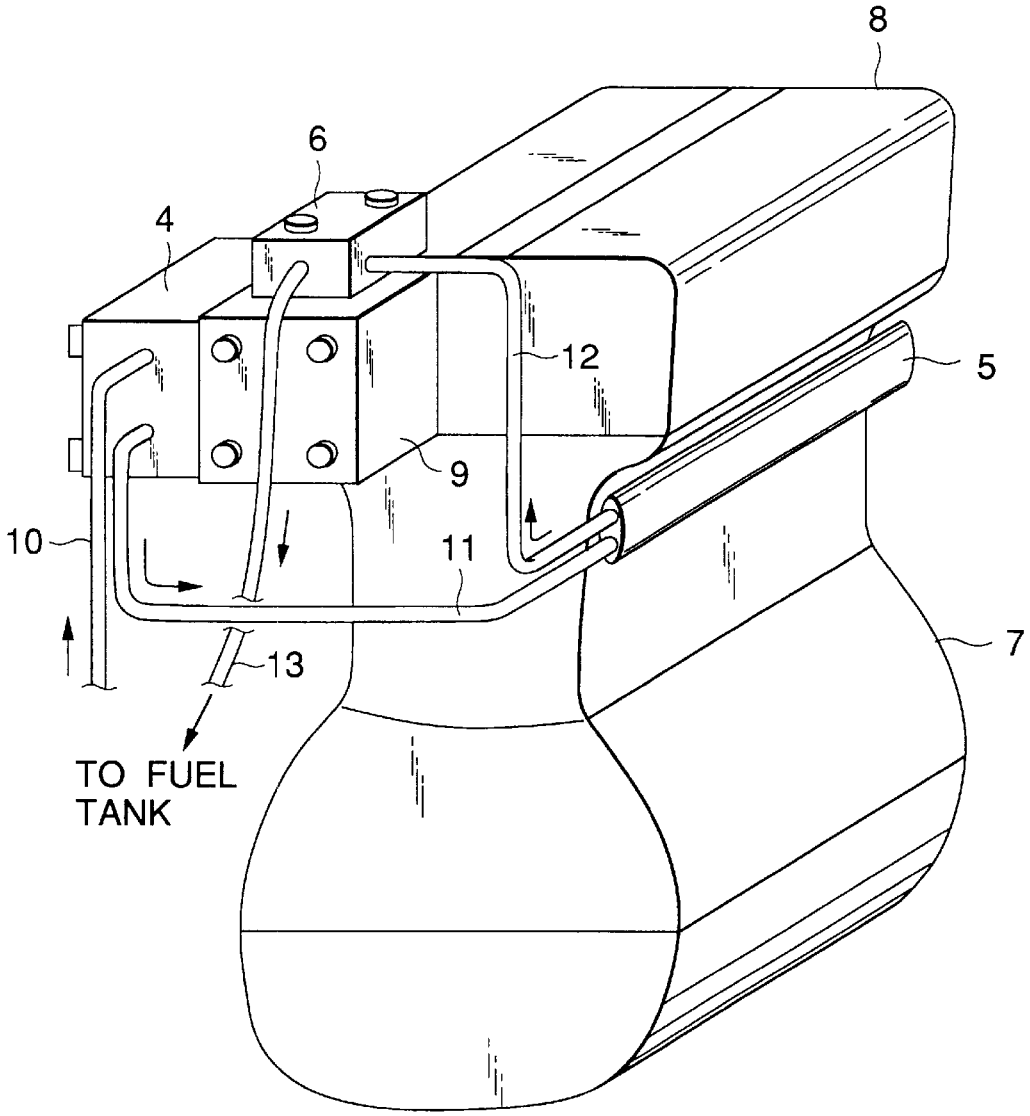
FIG. 1 is a perspective view showing the fuel supply apparatus according to the first embodiment of the invention.
Figure 2:
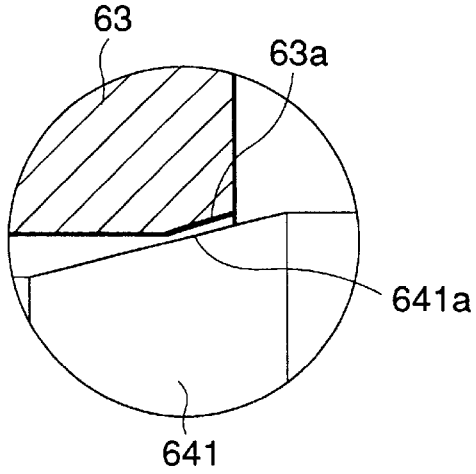
FIG. 2 is an enlarged sectional diagram showing the main part of a high-pressure regulator in FIG. 1.
Figure 3:
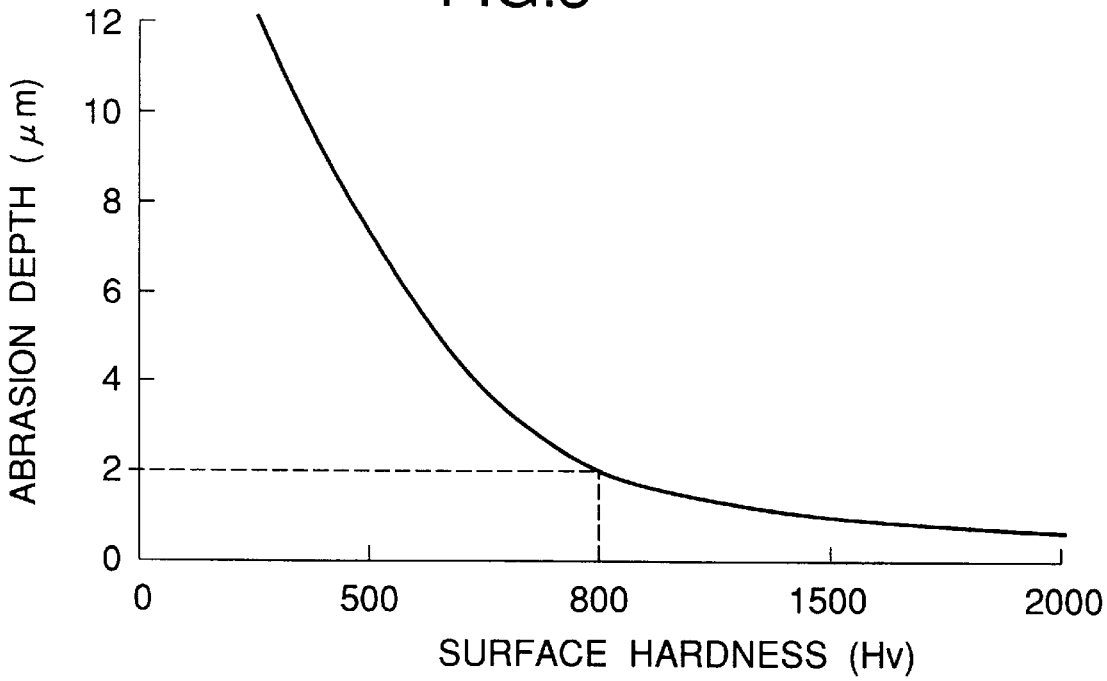
FIG. 3 is a characteristic diagram showing the abrasion depth with respect to the surface hardness in the high-pressure regulator according to the first embodiment of the invention.

FIG. 1 is a perspective view showing the fuel supply apparatus according to the present invention, FIG. 2 is an enlarged sectional diagram showing the main part of a high-pressure regulator in FIG. 1, and FIG. 3 is a characteristic diagram showing the abrasion depth with respect to the surface hardness in the high-pressure regulator shown in FIG. 2.

In FIGS. 1 and 2, a reference numeral 7 designates an in-cylinder direct fuel injection type gasoline engine and 8 a cylinder head of the engine. A high-pressure pump 4 is attached to the side wall of the cylinder head 8. A delivery pipe 5 is attached to the lower portion of the cylinder head 8.

A reference numeral 9 designates a cam casing attached to the side wall of the cylinder head 8 together with the high-pressure pump 4. A cam for driving the high-pressure pump 4 is housed within the cam casing 9. A high-pressure regulator 6 is secured to the upper portion of the cam casing 9. A reference numeral 10 designates a pipe for conducting the fuel forcedly fed from the low-pressure pump 2 to the high-pressure pump 4, 11; a pipe for coupling the high-pressure pump to the delivery pipe 5, 12; a pipe for coupling the high-pressure regulator 6 to the delivery pipe 5 and 13; a pipe for returning the fuel from the high-pressure regulator 6 to the fuel tank 1.

In the enlarged diagram showing the main part of the high-pressure regulator 6 shown in FIG. 2, a seat portion 63*a* serving as the abutment portion of a valve seat 63 is set in its hardness at the conventional Vickers hardness of Hv650. A reference numeral 641 designates a valve having a seat portion 641*a* capable of abutting against the seat portion 63*a* of the valve seat 63. The seat portion 641*a* is subjected to the nitriding process thereby to be set to have the Vickers hardness of Hv900.

In the high-pressure regulator 6 according to the embodiment, the seat portion 641*a* of the valve 641 is set to have the Vickers hardness of Hv900 larger than Hv800, so that the abrasion of the valve 641 can be reduced remarkably as shown in FIG. 3. Thus, since only the seat portion 63*a* of the valve seat 63 is worn away, the sealing property of the valve and the valve seat can be secured even when the valve 641 rotates. FIG. 3 shows the relation of the abrasion depth with respect to the surface hardness in the seat portion 641*a* of the valve 641 of the high-pressure regulator 6 according to the first embodiment. As clear from FIG. 3, when the hardness of the seat portion 641*a* of the valve 641 is set to be Hv800 or more, preferably to be Hv1000 or more, an amount of the abrasion can be reduced remarkably.

As a consequence, the high-pressure regulator 6 can perform the pressure control normally and the delivery pipe 5 is prevented from being reduced in the fuel pressure, so that the injectors can perform the fuel injection suitably.

Second Embodiment

Figure 4:
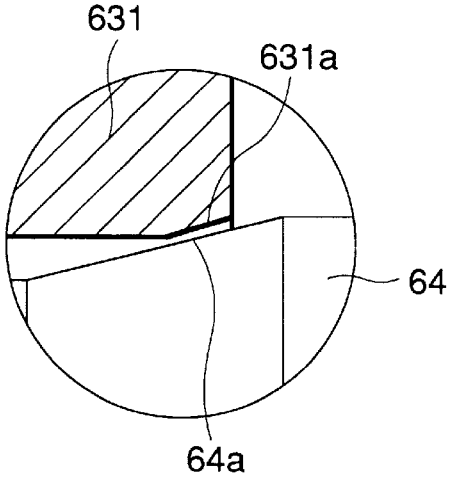
FIG. 4 is an enlarged sectional diagram showing the main part of a high-pressure regulator according to the second embodiment of the invention.

FIG. 4 is an enlarged sectional diagram showing the main part of the high-pressure regulator 6 according to the second embodiment of the present invention.

In FIG. 4, a seat portion 64*a* serving as the abutment portion of a valve 64 is set to have the conventional hardness of Hv650. A reference numeral 631 designates a valve seat having a seat portion 631*a* capable of abutting against the seat portion 64*a* of the valve 64. The seat portion 631*a* is subjected to the nitriding process thereby to be set to have the Vickers hardness of Hv900 larger than Hv800.

In the high-pressure regulator 6 according to the second embodiment, the seat portion 631*a* of the valve 631 is set to have the hardness of Hv900, so that the abrasion of the valve 631 can be reduced remarkably. Thus, since only the seat portion 64*a* of the valve 64 is worn away, the sealing property can be secured even when the valve 64 rotates, so that the effects like the first embodiment can be obtained.

Third Embodiment

Figure 5:
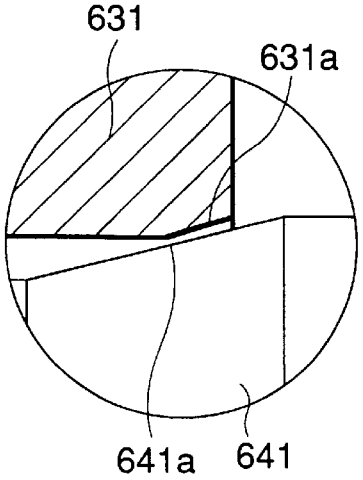
FIG. 5 is an enlarged sectional diagram showing the main part of a high-pressure regulator according to the third embodiment of the invention.

FIG. 5 is an enlarged sectional diagram showing the main part of the high-pressure regulator 6 according to the third embodiment of the present invention.

In FIG. 5, a reference numeral 631 designates a valve seat having a seat portion 631*a* serving as an abutment portion. The seat portion 631*a* is subjected to the nitriding process thereby to be set to have the hardness of Hv900. A reference numeral 641 designates a valve having a seat portion 641*a* capable of abutting against the seat portion 631*a* of the valve seat 631. The seat portion 641*a* is subjected to the nitriding process thereby to be set to have the hardness of Hv900.

In the high-pressure regulator 6 according to the third embodiment, the seat portion 631*a* of the valve seat 631 is set to have the hardness of Hv900 and the seat portion 641*a* of the valve 641 is also set to have the hardness of Hv900, so that the abrasion of both the seat portions 631 and 641*a* can be reduced and hence the sealing property can be secured.

Fourth Embodiment

Figure 6:
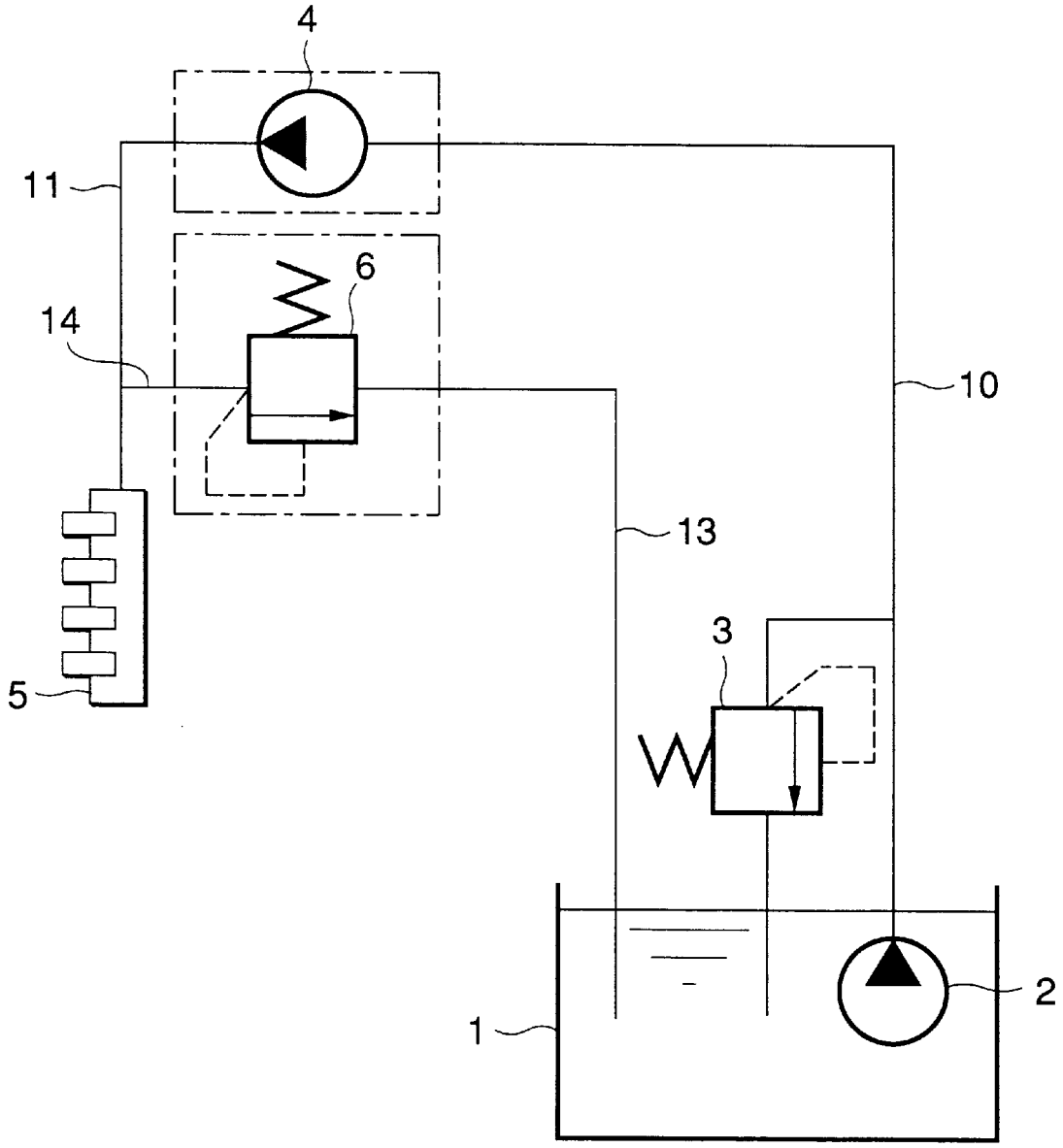
FIG. 6 is a block diagram showing the arrangement of a fuel supply apparatus according to the fourth embodiment of the invention.
Figure 7:
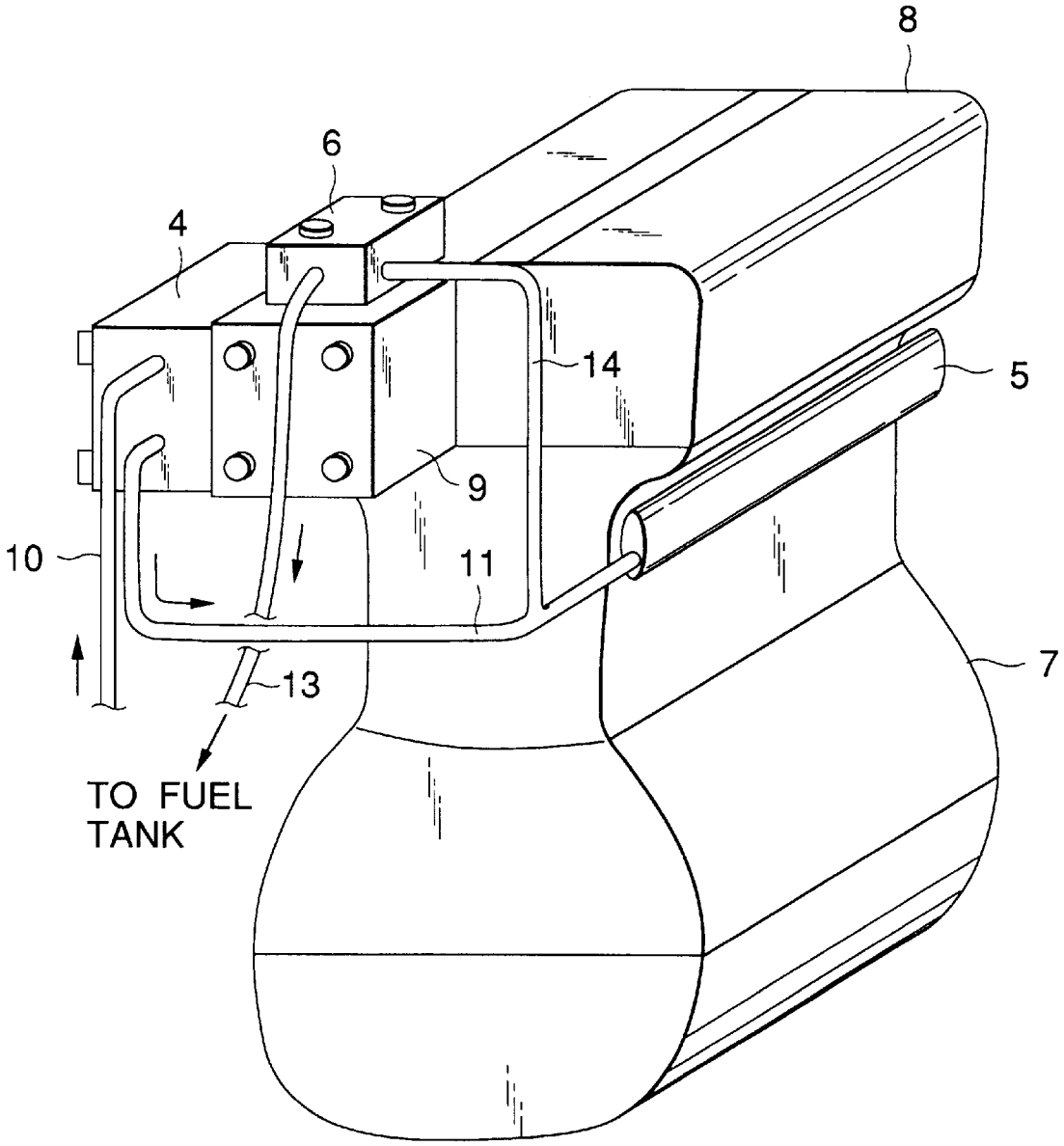
FIG. 7 is a perspective view showing the arrangement of the fuel supply apparatus shown in FIG. 6.

FIG. 6 is a block diagram showing the arrangement of the fuel supply apparatus according to the fourth embodiment of the present invention and FIG. 7 is a perspective view showing the arrangement of the fuel supply apparatus shown in FIG. 6.

In FIGS. 6 and 7, a reference numeral 6 designates a high-pressure regulator coupled between the high-pressure pump 4 and the delivery pipe 5. The seat portion of the valve of the high-pressure regulator is set to have the hardness of Hv900 like the first embodiment. A reference numeral 14 designates a pipe having one end coupled to the high-pressure regulator 6 and the other end coupled to a pipe 11. The high-pressure regulator 6 is secured integrally to the upper surface of the cam casing 9.

In the fuel supply apparatus according to the fourth embodiment, since the high-pressure regulator 6 is disposed and coupled between the high-pressure pump 4 and the delivery pipe 5, such a conventional phenomenon can be prevented that heat is conducted to the fuel when the fuel passes through the delivery pipe 5 and the fuel thus heated is introduced into the valve portion of the high-pressure regulator 6. Thus, the temperature of the fuel at the high-pressure regulator 6 can be reduced, so that the fuel is prevented from being boiled. Accordingly, since such a phenomenon can be prevented that the valve abuts against the valve seat in substantially dehydrated state, the abrasion of the abutment portions can be reduced. Further, since the bubbles are prevented from being generated at the clearance between the valve and the valve seat, the occurrence of the cavitation erosion can be prevented.

Fifth Embodiment

Figure 8:
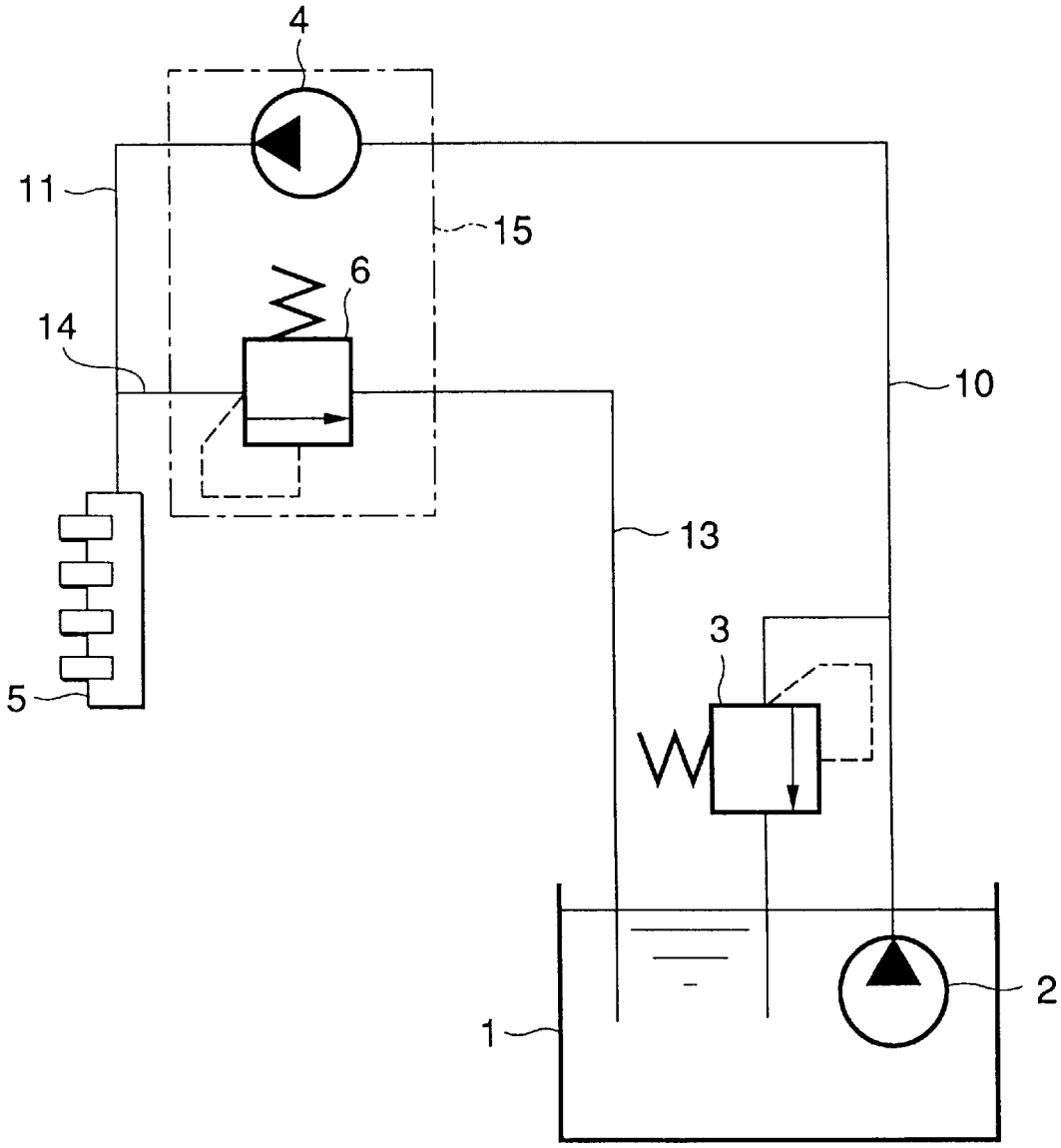
FIG. 8 is a block diagram showing the arrangement of a fuel supply apparatus according to the fifth embodiment of the invention.

As shown in FIG. 8, in this embodiment, since both the high-pressure pump 4 and the high-pressure regulator 6 are integrally mounted within the same casing 15, the configuration of the fuel supply apparatus can be simplified due to the reduction of the number of external pipes and the provision of the common casing.

Sixth Embodiment

Figure 9:
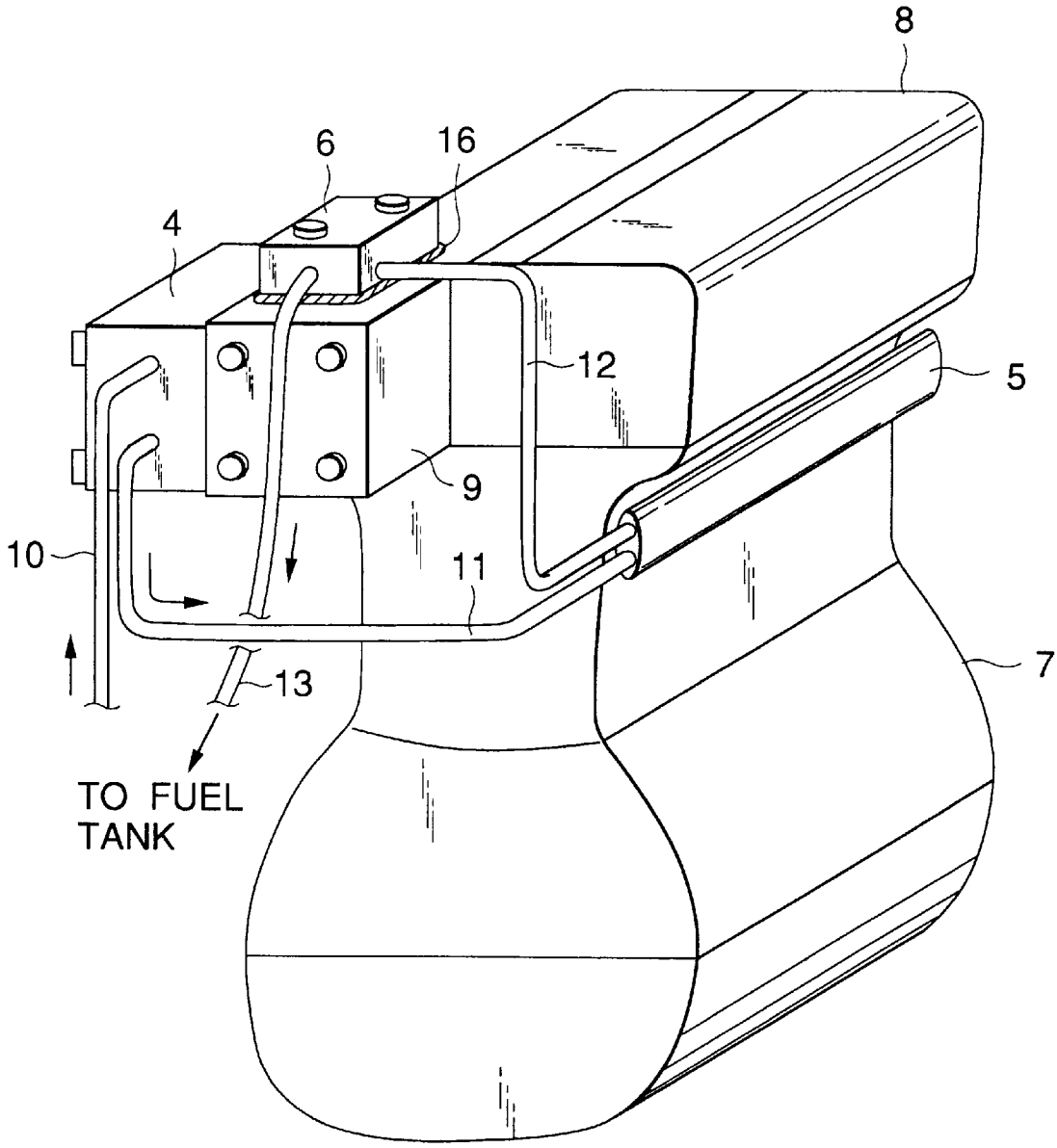
FIG. 9 is a perspective view showing the arrangement of the fuel supply apparatus according to the sixth embodiment of the invention.

FIG. 9 is a perspective view showing the arrangement of the fuel supply apparatus according to the sixth embodiment of the present invention.

In FIG. 9, a reference numeral 16 designates a heat insulator formed by insulating material and disposed between the high-pressure regulator 6 and the cam casing 9.

In the fuel supply apparatus according to the sixth embodiment, since an amount of heat to be transmitted from the cylinder head 8 of the engine 7 to the high-pressure regulator 6 through the cam casing 9 can be suppressed by the heat insulator 16, the temperature increase of the fuel within the high-pressure regulator 6 can be suppressed, so that the fuel is prevented from being boiled. Accordingly, since such a phenomenon can be prevented that the valve abuts against the valve seat in substantially dehydrated state, the abrasion of the abutment portions can be reduced. Further, since the bubbles are prevented from being generated at the valve and the valve seat, the occurrence of the cavitation erosion can be prevented.

Seventh Embodiment

Figure 10:
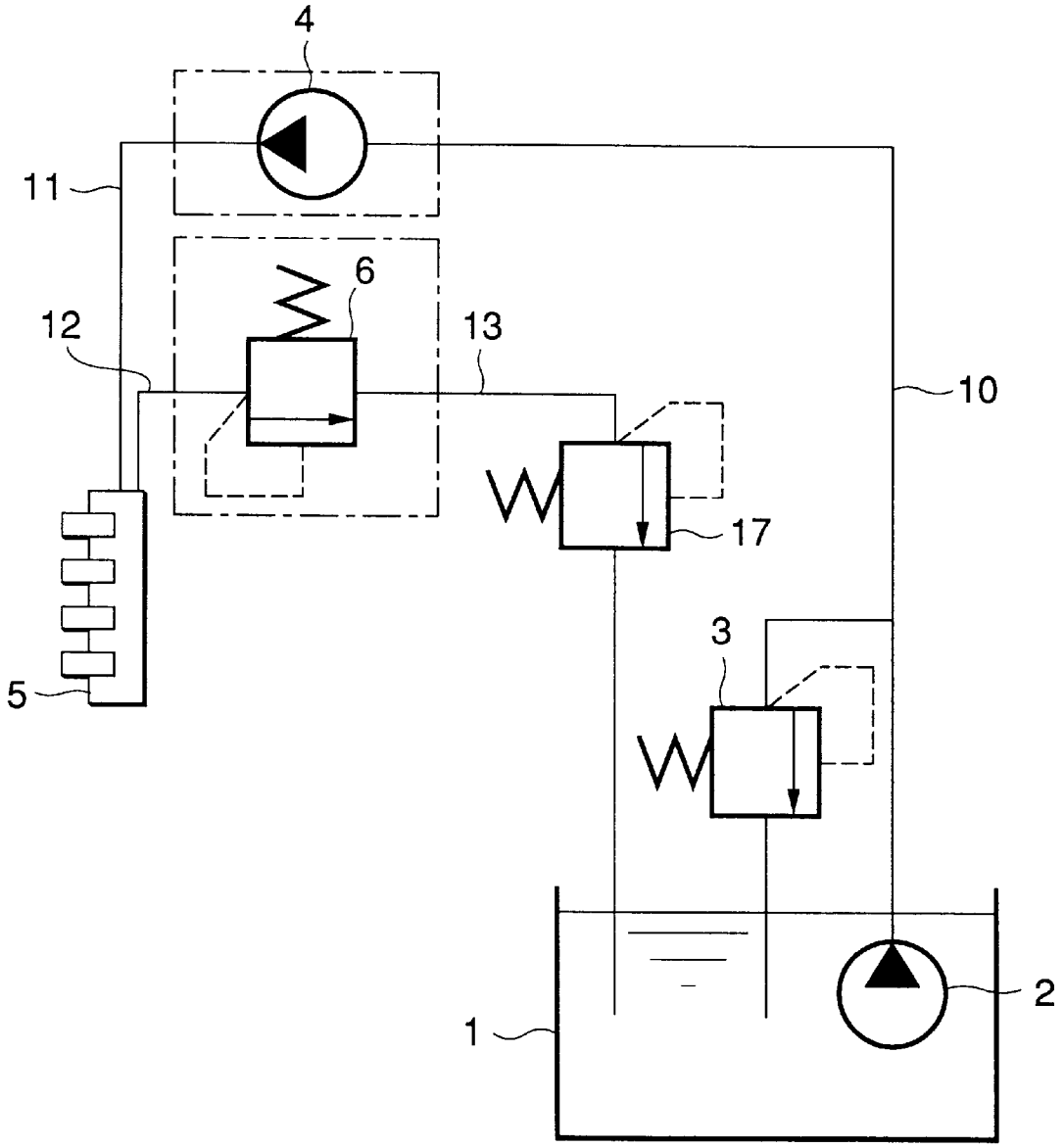
FIG. 10 is a block diagram showing the arrangement of a fuel supply apparatus according to the seventh embodiment of the present invention.

In the seventh embodiment shown in FIG. 10, since a low-pressure regulator 17 is disposed on the way of a return pipe 13 of a high-pressure regulator 6, it becomes possible to set the back pressure of the high-pressure regulator 6 at 1 $kgf/cm^2$ or more. As a consequence, the fuel is suppressed in the pressure reduction after passing through the valve of the high-pressure regulator 6, so that the boiling of the fuel can be prevented. Further, the abrasion of the valve and the valve seat in the high-pressure regulator 6 can be further reduced and the occurrence of the cavitation erosion can be prevented.

Eighth Embodiment

Figure 11:
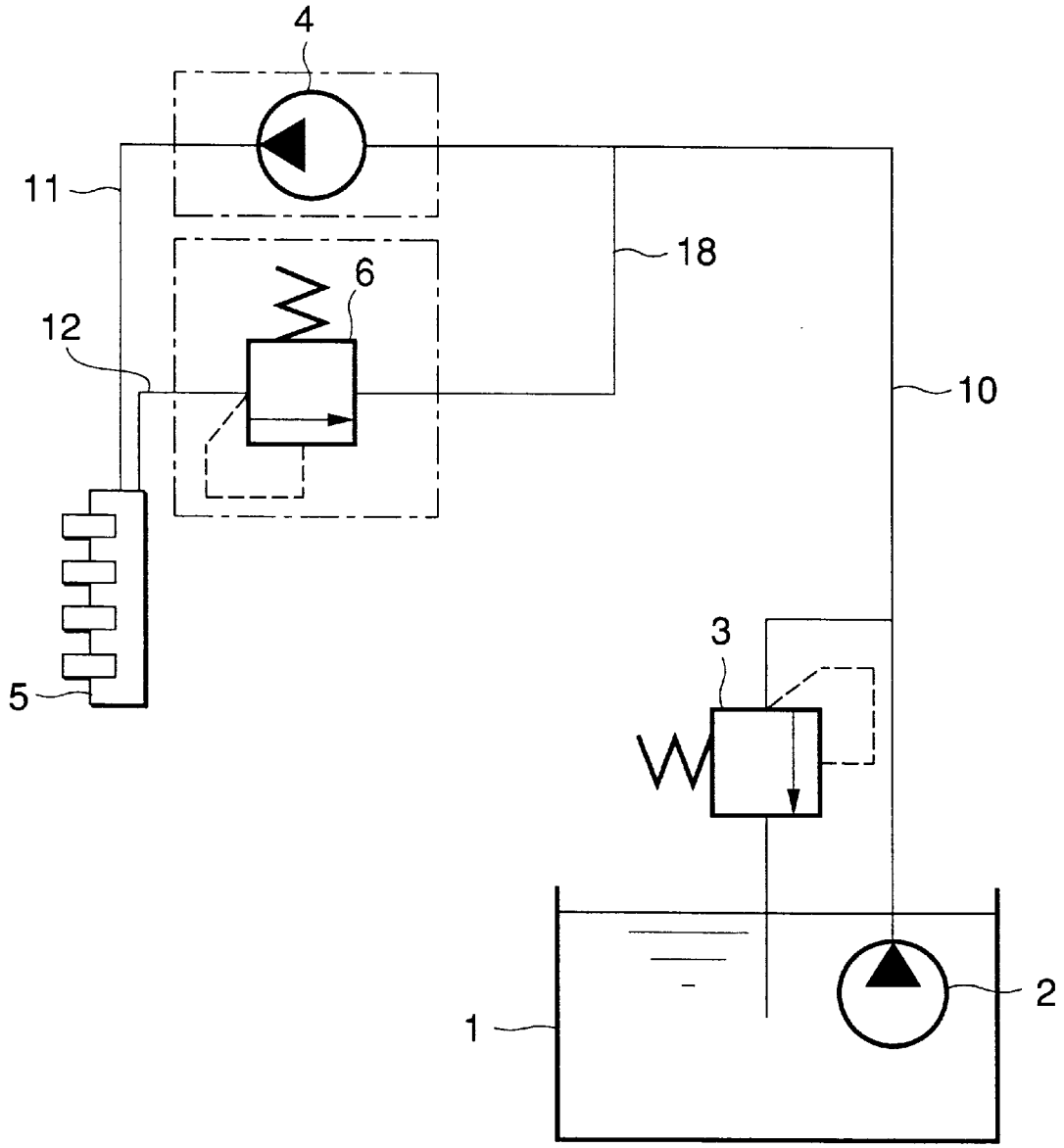
FIG. 11 is a block diagram showing the arrangement of a fuel supply apparatus according to the eighth embodiment of the invention.

In the eighth embodiment shown in FIG. 11, since a return path 18 of a high-pressure regulator 6 is returned to the suction side of a high-pressure pump 4, the back pressure can be applied to the return side of the high-pressure regulator 6 like the seventh embodiment. Accordingly, the function and effects like the seventh embodiment can be attained, and the configuration of the fuel supply apparatus can be simplified and the cost thereof can be reduced since the number of parts used in the apparatus can be reduced.

Ninth Embodiment

Figure 12:
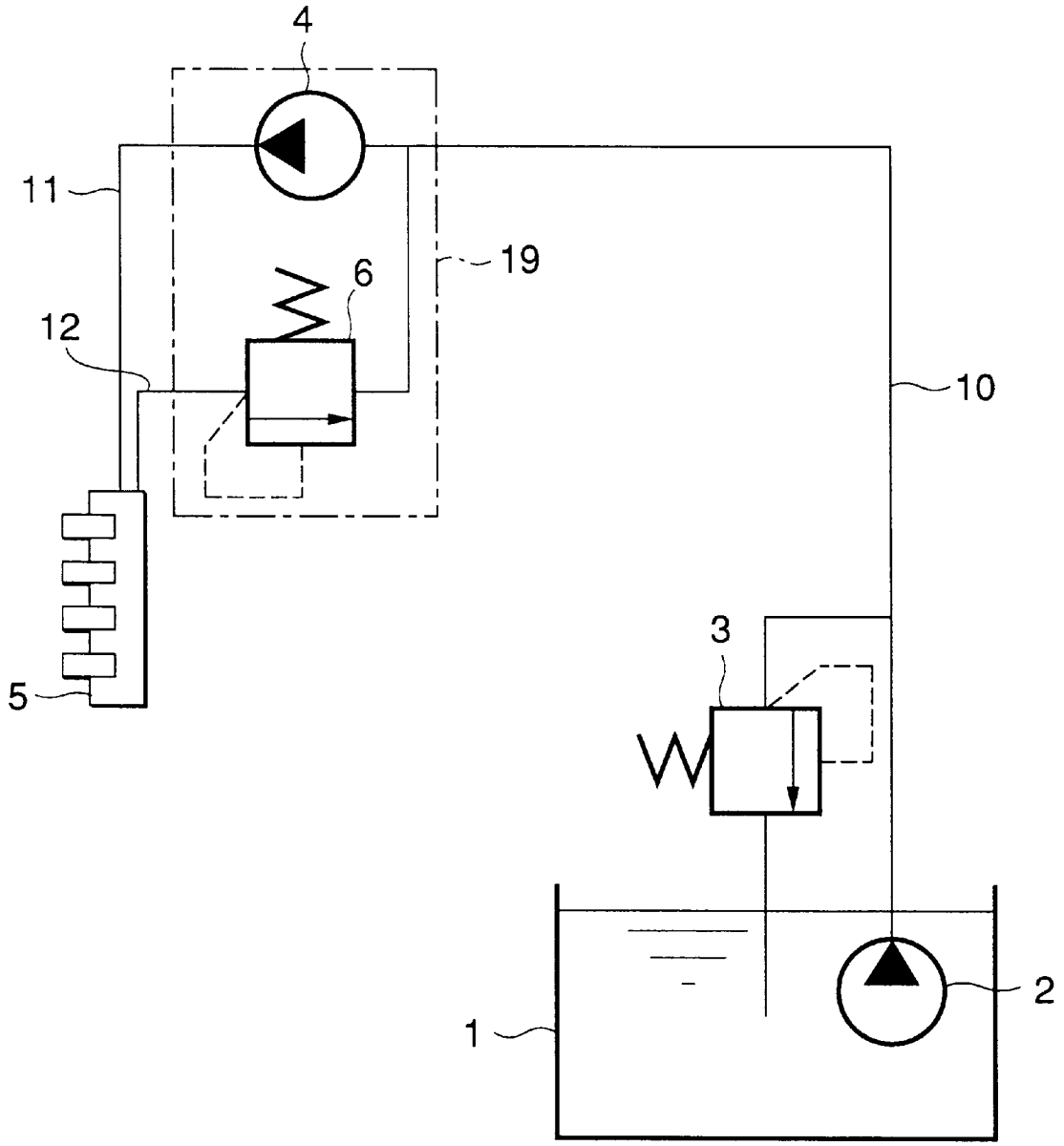
FIG. 12 is a block diagram showing the arrangement of a fuel supply apparatus according to the ninth embodiment of the invention.
Figure 13:
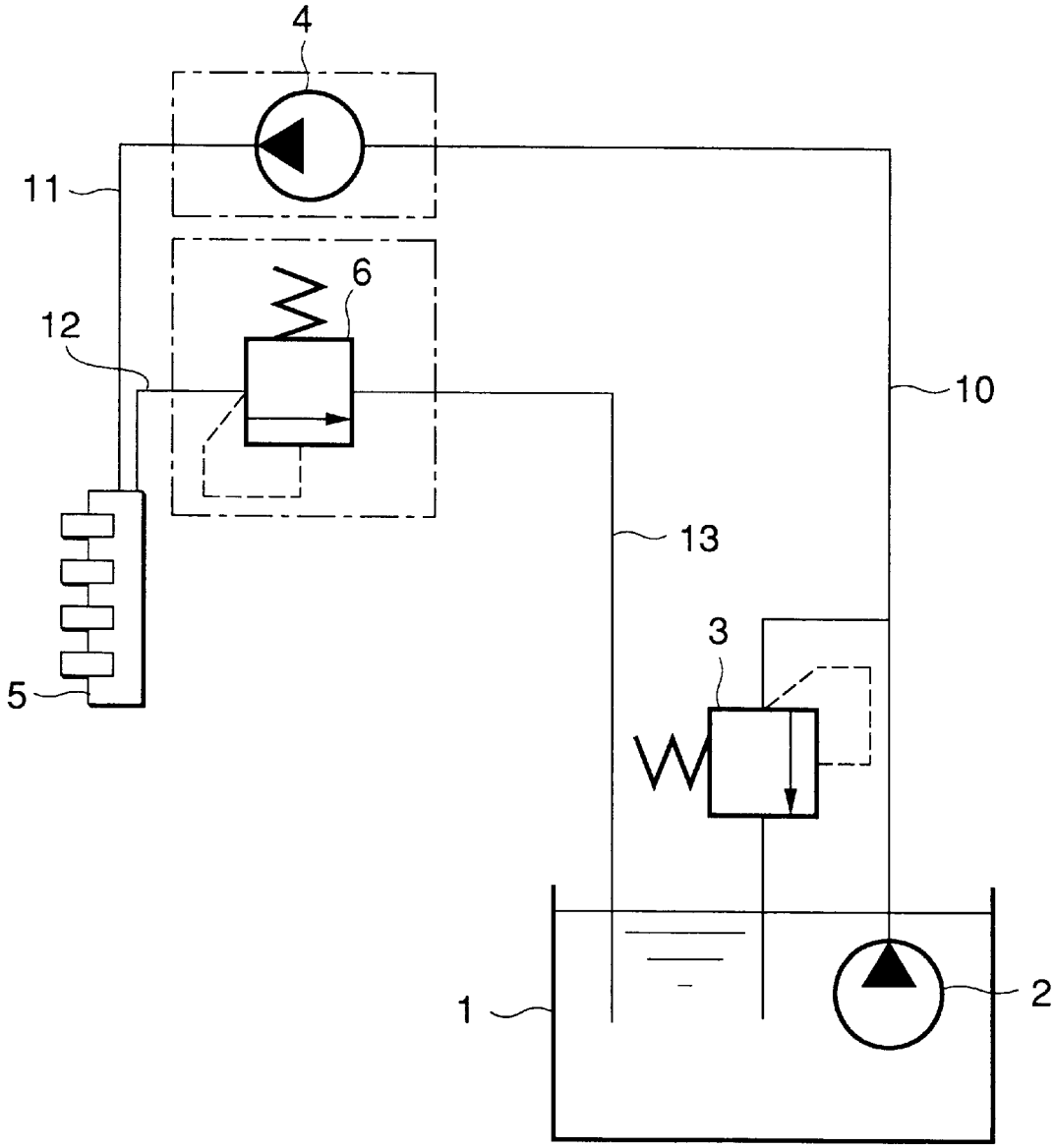
FIG. 13 is a block diagram showing the arrangement of a conventional fuel supply apparatus.
Figure 14:
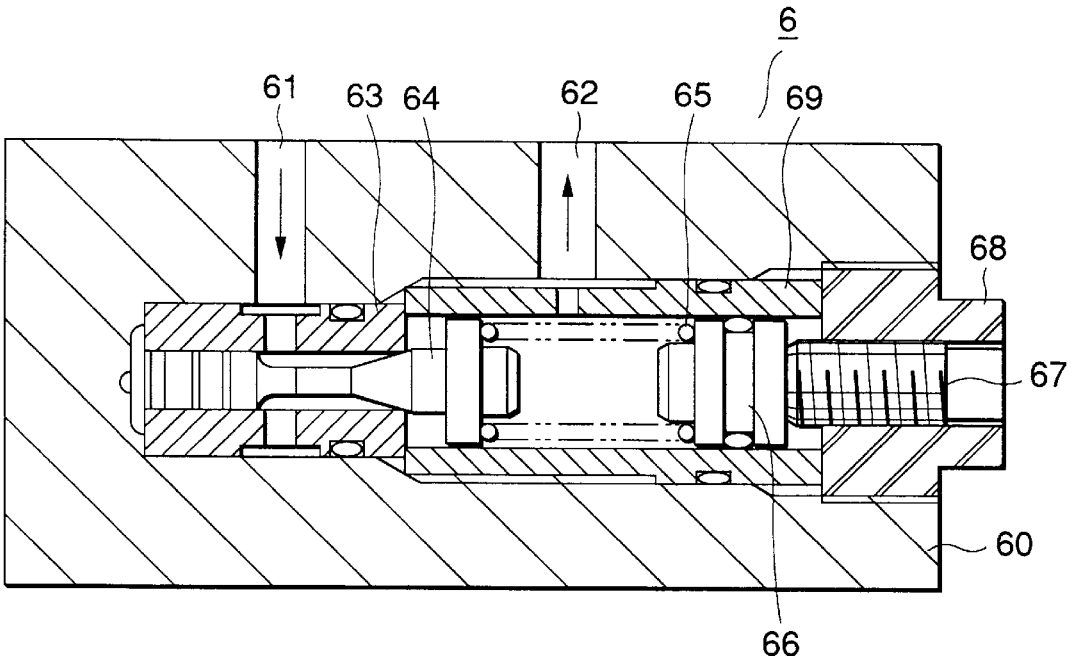
FIG. 14 is a sectional diagram showing the arrangement of a conventional high-pressure regulator.
Figure 15:
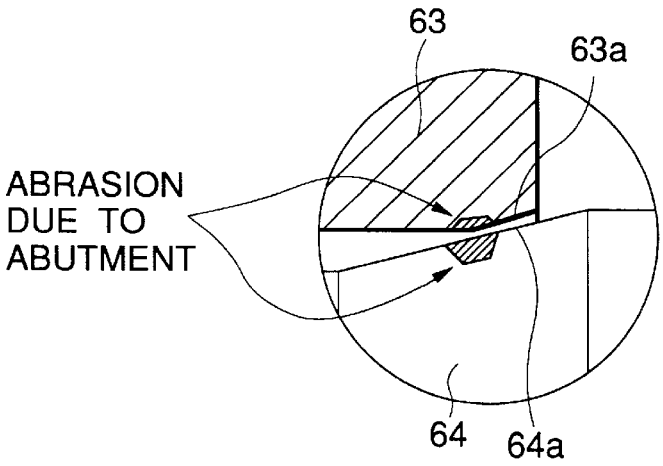
FIG. 15 is an enlarged sectional diagram showing the main part of the conventional high-pressure regulator.

As shown in FIG. 12, the ninth embodiment is arranged in a manner that, in addition to the arrangement of the eighth embodiment, both a high-pressure pump 4 and a high-pressure regulator 6 are integrally formed by the same casing 19. Accordingly, since the external pipes and the casings are commonly used, the configuration of the fuel supply apparatus can be further simplified and the cost thereof can be further reduced.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

As described above, since the fuel supply apparatus according to the present invention is arranged in a manner that at least one of the abutment surfaces of the valve and the valve seat of the high-pressure regulator is set to have a hardness of Hv800 or more, only one of the valve and the valve seat is worn away and the amount of abrasion can be reduced. Thus, the sealing property can be secured even when the valve rotates. Accordingly, the high-pressure regulator can perform the pressure control normally and the delivery pipe is prevented from being reduced in the fuel pressure, so that the injectors can perform the fuel injection suitably.

Further, in the fuel supply apparatus, the high-pressure regulator may be disposed between the high-pressure pump and the delivery pipe. With this structure, the temperature of the fuel at the high-pressure regulator can be reduced, so that the fuel is prevented from being boiled. Accordingly, since such a phenomenon can be prevented that the valve abuts against the valve seat in a substantially dehydrated state, the abrasion of the abutment portions can be reduced. Further, since the bubbles are prevented from being generated at the clearance between the valve and the valve seat, the occurrence of the cavitation erosion can be prevented.

In addition, in the fuel supply apparatus, both the high-pressure regulator and the high-pressure pump may be mounted in the same casing. Thus, the external pipes and the casings are commonly used, whereby the configuration of the fuel supply apparatus can be simplified and the cost thereof can be reduced.

Moreover, in the fuel supply apparatus, insulating material may be provided at the attachment surface of the high-pressure regulator. Therefore, the temperature increase of the fuel at the high-pressure regulator can be suppressed, so that the fuel is prevented from being boiled. Accordingly, since such a phenomenon can be prevented that the valve abuts against the seat portion in a substantially dehydrated state, the abrasion of the abutment portions can be reduced. Further, since the bubbles are prevented from being generated at the clearance between the valve and the seat portion, the occurrence of the cavitation erosion can be prevented.

In addition, in the fuel supply apparatus, back pressure of 1 $kgf/cm^2$ or more may be applied to the return side of the high-pressure regulator. Therefore, the fuel is suppressed in the pressure reduction after passing through the valve of the high-pressure regulator, so that the boiling of the fuel can be prevented. Further, the abrasion of the valve and the valve seat in the high-pressure regulator can be further reduced and the occurrence of the cavitation erosion can be prevented.

Moreover, in the fuel supply apparatus, the return side of the high-pressure regulator may be returned to the suction side of the high-pressure pump. Therefore, the back pressure can be applied to the return side of the high-pressure regulator with a simplified configuration. Accordingly, the fuel is suppressed in the pressure reduction after passing through the valve of the high-pressure regulator, so that the boiling of the fuel can be prevented. Further, the abrasion of the valve and the valve seat in the high-pressure regulator can be reduced and the occurrence of the cavitation erosion can be prevented. Furthermore, the configuration of the fuel supply apparatus can be simplified and the cost thereof can be reduced since the number of parts used in the apparatus can be reduced.

What is claimed is:

1. A fuel supply apparatus comprising:

a high-pressure pump driven by an engine and ejecting high-pressure fuel;

a delivery pipe storing the high-pressure fuel ejected from said high-pressure pump in a pressurized state; and a high-pressure regulator having a valve and a valve seat, and adjusting the fuel pressure in one of said high-pressure pump and said delivery pipe, wherein at least one of abutment surfaces of said valve and said valve seat is set to have a hardness of Hv800 or more.

2. A fuel supply apparatus according to claim 1, wherein said high-pressure regulator is disposed between said high-pressure pump and said delivery pipe.

3. A fuel supply apparatus according to claim 1, wherein both said high-pressure regulator and said high-pressure pump are mounted in a same casing.

4. A fuel supply apparatus according to claim 1, wherein insulating material is provided at an attachment surface of said high-pressure regulator.

5. A fuel supply apparatus according to claim 1, wherein back pressure of 1 $kgf/cm^2$ or more is applied to a return side of said high-pressure regulator.

6. A fuel supply apparatus according to claim 1, wherein a return side of said high-pressure regulator is returned to a suction side of said high-pressure pump.

* * * * *